US011848141B2

(12) United States Patent
Yoshikawa et al.

(10) Patent No.: US 11,848,141 B2
(45) Date of Patent: Dec. 19, 2023

(54) REACTOR

(71) Applicants: AutoNetworks Technologies, Ltd., Yokkaichi (JP); Sumitomo Wiring Systems, Ltd., Yokkaichi (JP); Sumitomo Electric Industries, Ltd., Osaka (JP)

(72) Inventors: Kohei Yoshikawa, Yokkaichi (JP); Akinori Ooishi, Yokkaichi (JP)

(73) Assignees: AutoNetworks Technologies, Ltd., Yokkaichi (JP); Sumitomo Wiring Systems, Ltd., Yokkaichi (JP); Sumitomo Electric Industries, Ltd., Osaka (JP)

( * ) Notice: Subject to any disclaimer, the term of this patent is extended or adjusted under 35 U.S.C. 154(b) by 509 days.

(21) Appl. No.: 17/263,384

(22) PCT Filed: Aug. 1, 2019

(86) PCT No.: PCT/JP2019/030179
§ 371 (c)(1),
(2) Date: Jan. 26, 2021

(87) PCT Pub. No.: WO2020/031831
PCT Pub. Date: Feb. 13, 2020

(65) Prior Publication Data

US 2021/0304948 A1 Sep. 30, 2021

(30) Foreign Application Priority Data

Aug. 9, 2018 (JP) ..... 2018-150907

(51) Int. Cl.
*H01F 27/24* (2006.01)
*H01F 27/28* (2006.01)
*H01F 27/32* (2006.01)

(52) U.S. Cl.
CPC ..... *H01F 27/28* (2013.01); *H01F 27/24* (2013.01); *H01F 27/327* (2013.01)

(58) Field of Classification Search
CPC ..... H01F 27/28; H01F 27/24; H01F 27/327; H01F 27/263; H01F 37/00; H01F 27/26; H01F 27/266
See application file for complete search history.

(56) References Cited

U.S. PATENT DOCUMENTS

| | | | |
|---|---|---|---|
| 10,665,386 B2 | 5/2020 | Hirabayashi et al. | |
| 11,450,468 B2 * | 9/2022 | Inaba | H01F 3/10 |
| 2012/0154093 A1 | 6/2012 | Yoshikawa et al. | |

FOREIGN PATENT DOCUMENTS

| | | |
|---|---|---|
| JP | 2015-211143 A | 11/2015 |
| JP | 2016-100569 A | 5/2016 |
| JP | 2016-149453 A | 8/2016 |

OTHER PUBLICATIONS

International Search Report, Application No. PCT/JP2019/030179, dated Oct. 1, 2019. ISA/Japan Patent Office.

* cited by examiner

*Primary Examiner* — Tuyen T Nguyen
(74) *Attorney, Agent, or Firm* — Honigman LLP

(57) ABSTRACT

Provided is a reactor that includes a coil having a winding portion, a magnetic core having an inner core portion and an outer core portion, and a resin molded portion covering a surface of the magnetic core. The inner core portion is a single body having a non-separated structure, and includes a groove portion provided along a direction intersecting with the axial direction in a surface in the vicinity of an end portion of the inner core portion located in the axial direction. The resin molded portion includes an outer resin portion and an inner resin portion that covers the surface of the end portion of the inner core portion located in the axial (Continued)

direction and with which an inner portion of the groove portion is filled. The inner resin portion is continuous with the outer resin portion.

14 Claims, 5 Drawing Sheets

REACTOR

CROSS-REFERENCE TO RELATED APPLICATIONS

This application is the U.S. national stage of PCT/JP2019/030179 filed on Aug. 1, 2019, which claims priority of Japanese Patent Application No. JP 2018-150907 filed on Aug. 9, 2018, the contents of which are incorporated herein.

TECHNICAL FIELD

The present disclosure relates to a reactor.

BACKGROUND

JP 2017-135334A discloses a reactor that includes a coil having winding portions obtained by winding a winding wire, and a magnetic core forming a closed magnetic circuit, and that is utilized in a constituting component of a converter of a hybrid automobile. The magnetic core includes a plurality of inner core pieces disposed inside the winding portion, and outer core pieces disposed outside the winding portion. The inner core pieces and the outer core pieces are held as a single body in this reactor due to an outer circumferential surface of the magnetic core being covered by a resin molded portion.

There is a risk that core pieces cannot be held as a single body due to a resin molded portion cracking or separating from a core piece because sufficient adhesion between the core piece and the resin molded portion cannot be obtained depending on the materials of core pieces and the resin molded portion. In order to avoid such a situation, when the thickness of the resin molded portion is increased, a large gap needs to be secured between the winding portion and the inner core pieces, resulting in an increase in the size of a reactor.

In view of this, one object of this disclosure is to provide a small reactor that can firmly hold a resin molded portion and a magnetic core as a single body.

SUMMARY

A reactor according to one aspect of this disclosure includes: a coil having a winding portion; a magnetic core having an inner core portion and an outer core portion; and a resin molded portion covering at least a portion of a surface of the magnetic core, in which the inner core portion is disposed in an inner portion of the winding portion. The outer core portion is disposed in an outer portion of the winding portion. The inner core portion is a single body having a non-separated structure. The inner core portion includes a groove portion provided along a direction intersecting with an axial direction in a surface in the vicinity of an end portion of the inner core portion located in the axial direction. The resin molded portion includes: an outer resin portion covering at least a portion of a surface of the outer core portion, and an inner resin portion that covers the surface of the end portion of the inner core portion located in the axial direction and with which an inner portion of the groove portion is filled, and the inner resin portion is continuous with the outer resin portion.

Advantageous Effects of the Present Disclosure

The reactor of this disclosure is small, and can firmly hold a magnetic core by a resin molded portion as a single body.

DETAILED DESCRIPTION OF PREFERRED EMBODIMENTS

Figure 1:
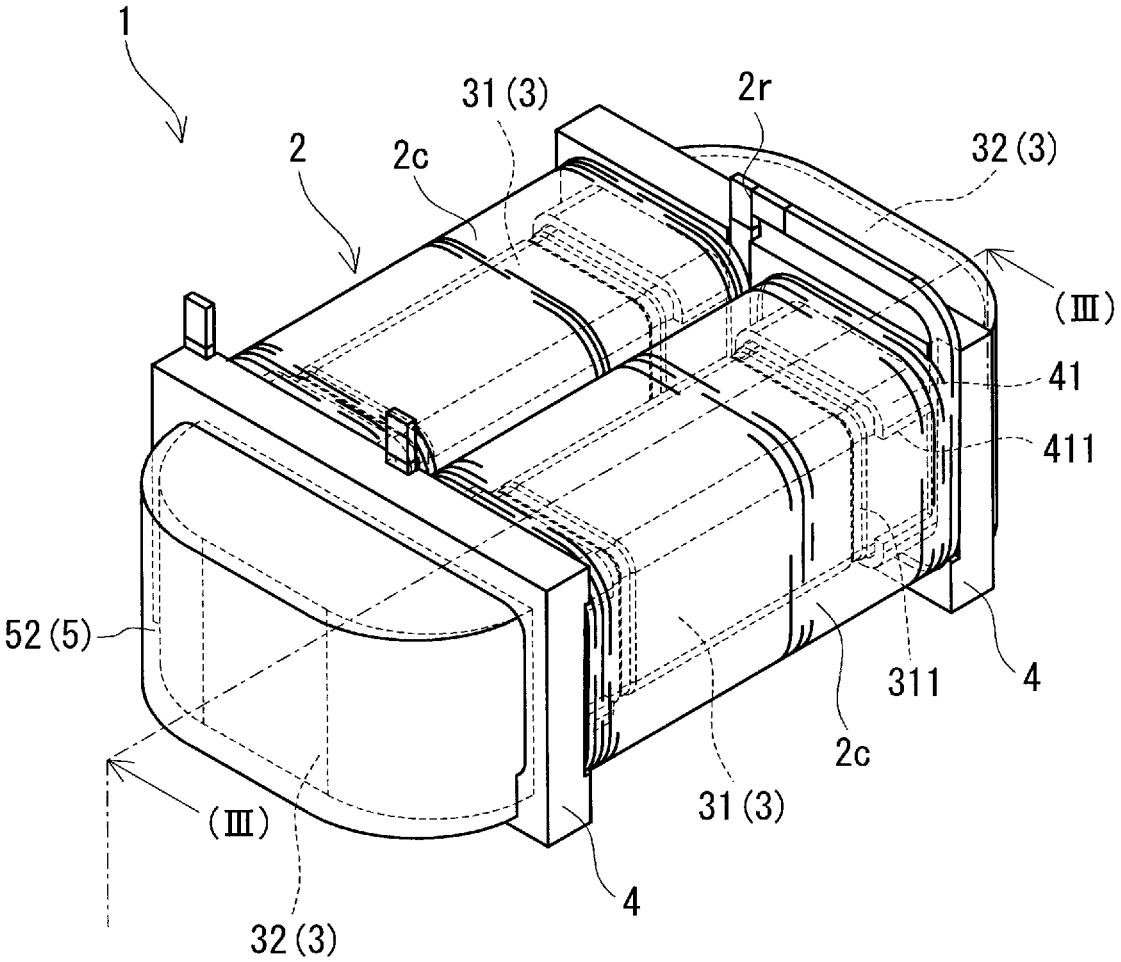
FIG. 1 is a schematic perspective view of a reactor according to Embodiment 1.

First, embodiments of this disclosure will be described.

A reactor according to one aspect of this disclosure includes: a coil having a winding portion; a coil having a winding portion; a magnetic core having an inner core portion and an outer core portion; and a resin molded portion covering at least a portion of a surface of the magnetic core, in which the inner core portion is disposed in an inner portion of the winding portion. The outer core portion is disposed in an outer portion of the winding portion. The inner core portion is a single body having a non-separated structure, and the inner core portion includes a groove portion provided along a direction intersecting with an axial direction in a surface in the vicinity of an end portion of the inner core portion located in the axial direction. The resin molded portion includes: an outer resin portion covering at least a portion of a surface of the outer core portion, and an inner resin portion that covers the surface of the end portion of the inner core portion located in the axial direction and with which an inner portion of the groove portion is filled, and the inner resin portion is continuous with the outer resin portion.

With the above-described reactor, the inner core portion is a single body having a non-separated structure, and the reactor is provided with the outer resin portion covering at least one portion of the surface of the outer core portion and the inner resin portion covering the surface of the end portion in the axial direction of the inner core portion, the outer resin portion and the inner resin portion being continuous with each other. Thus, the inner core portion and the outer core portion can be held as a single body by the resin molded portion. At this time, an inner portion of a groove portion formed in the inner core portion is filled with a portion of the inner resin portion. Thus, it is possible to form a fitting structure in which the inner resin portion in the groove portion is hooked on the inner core portion. The inner core portion and the outer core portion can be firmly held as a single body by the resin molded portion due to this fitting structure. Also, because of the above-described fitting structure, it is possible to firmly hold a magnetic core as a single body without making the resin molded portion thicker than necessary. Thus, it is possible to narrow the space between the winding portion and the inner core portion, and to obtain a small reactor. Even if the space between the winding portion and the inner core portion is narrowed, it is possible to reliably fill the groove portion with a portion of the inner resin portion. This is because the groove portion is provided in the vicinity of the end portion of the inner core portion in the axial direction.

According to one aspect of the reactor, the reactor includes a holding member for holding an end face of the winding portion in an axial direction of the winding portion and the outer core portion. The holding member is a frame-shaped body having a through-hole into which the end portion of the inner core portion located in the axial direction is inserted. The holding member includes a core support portion that protrudes from an inner circumferential face of the through-hole toward the center of the inner core portion. The core support portion is configured to support the surface of the end portion of the inner core portion located in the axial direction such that the groove portion is exposed, and the core support portion includes a notch portion that extends from the inner circumferential face of the through-hole to the groove portion.

The winding portion and the magnetic core can be easily positioned relative to each other via the holding member because the reactor includes the holding member. In particular, the inner core portion can be more easily positioned with respect to the winding portion because the holding member includes the core support portion. Even if the holding member includes the core support portion, the groove portion can be readily filled with resin due to the core support portion being provided with the notch portion. This is because, when the outer resin portion is formed by molding resin on the surface of the outer core portion, the resin is likely to enter between the winding portion and the inner core portion through the notch portion. That is to say, because the above-described notch portion functions as the path through which resin flows, the inner resin portion can be easily formed in a state in which the groove portion is filled with resin.

According to one aspect of the reactor, the groove portion may have portions located in opposing surfaces of the inner core portion.

Because the groove portions are provided in opposing surfaces of the inner core portion, it is possible to form a fitting structure in which the inner resin portion is fitted to the inner core portion at two positions on at least opposing surfaces out of the surfaces of the inner core portion. Because the above-described fitting structure can be formed on opposing surfaces of the inner core portion, the inner core portion and the outer core portion can be stably and firmly held as a single body by the resin molded portion.

According to one aspect of the reactor, the coil includes a pair of the winding portions that are disposed in parallel to each other, the inner core portion includes a pair of the inner core portions that are respectively disposed in inner portions of the winding portions, the groove portion includes: one end and another end that are located in opposing surfaces of the inner core portion, and an intermediate portion connecting the one end and the other end, and the intermediate portion is provided in a surface of the inner core portion located outward in a direction in which the inner core portions are disposed in parallel to each other.

If the two inner core portions that are respectively disposed in the inner portions of the two winding portions are provided, magnetic flux is likely to pass through regions of the inner core portions located inward in the parallel direction. Thus, because the groove portion is provided in the surface of the inner core portion located outward in the parallel direction, the passage of magnetic flux is unlikely to be inhibited, and it is possible to suppress deterioration of the magnetic properties thereof. The groove portion has one end and another end in opposing surfaces of the inner core portion, and the intermediate portion provided in the surface of the inner core portion located outward in the direction in which the inner core portions are disposed in parallel to each other is provided continuous with the one end and the other end. Because such a groove portions is provided, the inner core portion and the outer core portion can be stably and firmly held as a single body by the resin molded portion.

According to one aspect of the reactor, the inner core portion may be composed of a compact made of a composite material in which soft magnetic powder is dispersed in resin.

Because the inner core portion is composed of a compact made of the above-described composite material, the groove portion can be easily formed in the surface of the inner core portion.

According to one aspect of the reactor, the inner core portion may include a guide portion provided from an end face of the inner core portion located in the axial direction toward the groove portion.

Because the inner core portion includes the guide portion, when the outer resin portion is formed by molding resin on the surface of the outer core portion, the resin is likely to enter the groove portion passing through the guide portion, and the inside of the groove portion is readily filled with the resin. The inside of the guide groove portion is also filled with the resin. Because the inside of the guide groove portion is filled with resin, it is possible to increase the area of contact with the resin molded portion and the inner core portion, and the resin molded portion and the inner core portion can be easily and firmly held. Because the resin molded portion and the inner core portion can be firmly held, it is possible to more firmly hold the inner core portion and the outer core portion as a single body via the resin molded portion.

Specific examples of a reactor according to embodiments of this disclosure will be described below with reference to the drawings. The same reference numerals in the drawings indicate an object having the same name. Note that the present disclosure is not limited to these examples, but is indicated by the claims, and all changes that come within the meaning and range of equivalency of the claims are intended to be embraced therein.

Embodiment 1

Overview

A reactor 1 according to Embodiment 1 will be described with reference to FIGS. 1 to 4. The reactor 1 according to Embodiment 1 includes a coil 2 having winding portions 2*c*, a magnetic core 3 that is disposed inside and outside the winding portion 2*c* and forms a closed magnetic circuit, and a resin molded portion 5 covering at least a portion of a surface of the magnetic core 3. The magnetic core 3 includes inner core portions 31 disposed in inner portions of the winding portions 2*c* and outer core portions 32 disposed in outer portions of the winding portions 2*c*. The reactor 1 in these examples further include holding members 4 for holding the winding portions 2*c* and the magnetic core 3. One of the features of the reactor 1 according to Embodiment 1 is that the inner core portion 31 is a single body having a non-separated structure. Also, one of the features of the reactor 1 according to Embodiment 1 is that the surface of the inner core portion 31 in the vicinity of an end portion in the axial direction thereof includes a groove portion 311, and the groove portion 311 is filled with a portion of the resin molded portion 5.

The reactor 1 is installed in an installation target (not shown) such as a converter case, for example. Here, with the reactor 1, the lower side in a paper plane in FIG. 1 refers to the installation side facing the installation target, the installation side refers to "lower", the opposite side thereto is "upper", and the up-down direction refers to the vertical direction (height direction). Also, the direction in which the winding portions 2*c* of the coil 2 are disposed in parallel to each other refers to the horizontal direction (width direction), and a direction extending along the axial direction of the winding portions 2*c* refers to the length direction. The following describes the configuration of the reactor 1 in detail.

Coil

Figure 2:
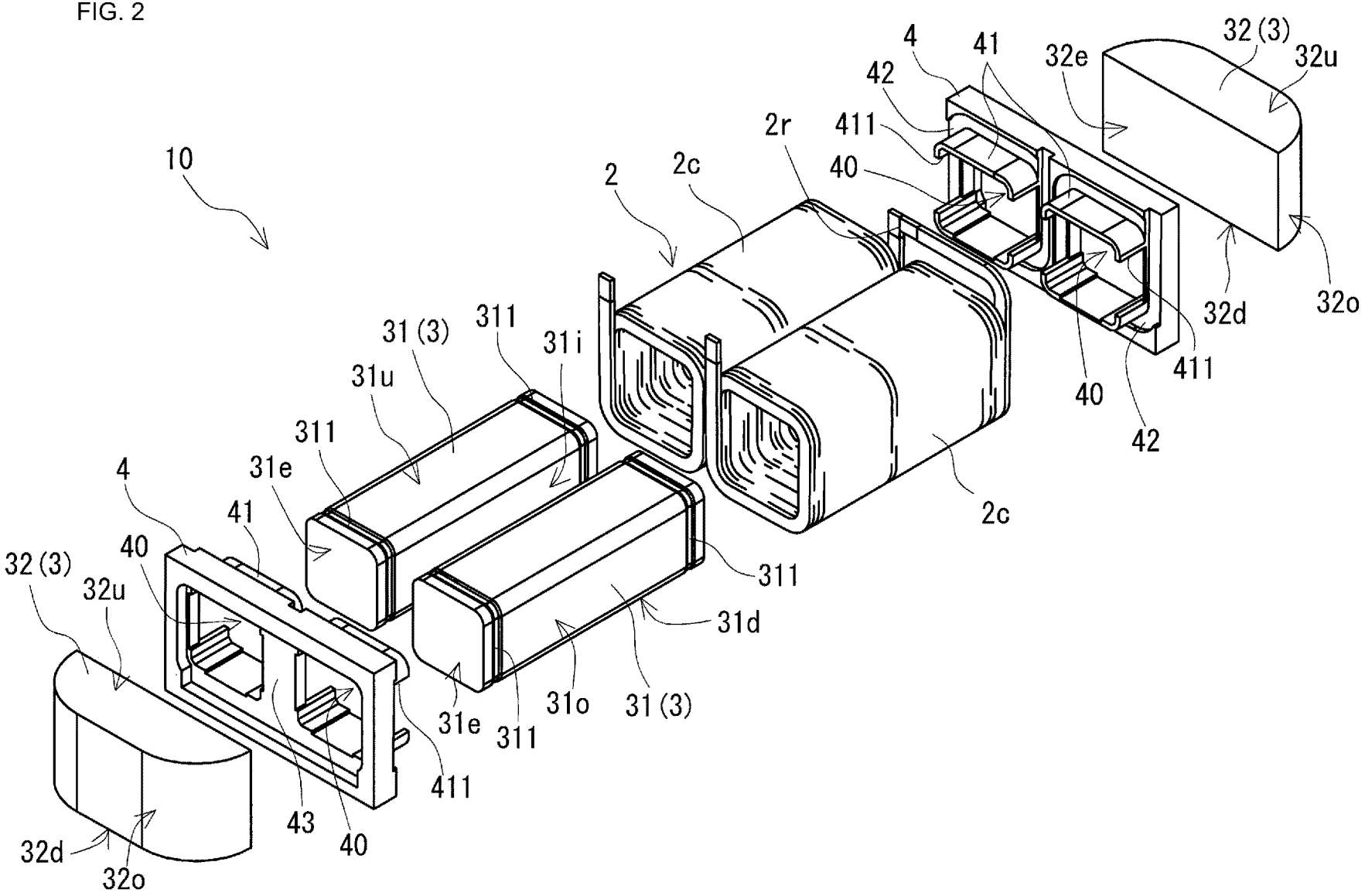
FIG. 2 is a schematic exploded perspective view of an assembly provided in the reactor according to Embodiment 1.

As shown in FIGS. 1 and 2, the coil 2 includes a pair of winding portions 2*c* obtained by winding a winding wire, and a joining portion 2*r* obtained by joining one end portion of each of the two winding portions 2*c* together. The winding portions 2*c* are formed by helically winding a winding wire to have a tubular shape. The two winding portions 2*c* are disposed horizontally (in parallel to each other) such that the axial directions thereof are parallel to each other. Various types of welding, soldering, brazing, or the like can be used to join the two winding portions 2*c* together and form the joining portion 2*r*. The other end portion of each of the two winding portions 2*c* are drawn out from the winding portions 2*c*, terminal fittings (not shown) are attached thereto, and the other end portions are to be electrically connected to external apparatuses (not shown) such as a power source for supplying power to the coil 2 and the like.

The winding portions 2*c* are each constituted by a coated flat wire (so-called enameled wire) that includes a conductor made of a flat wire made of copper or the like, and an insulating coating that is made of polyamide imide and covers an outer circumference of the conductor. In this example, both of the winding portions 2*c* are square tubular edgewise coils with rounded corner portions. Also, both of the winding portions 2*c* have the same shape, size, winding direction, and number of turns. A known coil provided with two winding portions 2*c* arranged side-by-side and having the same specification can be used as the coil 2. The coil may be formed by one continuous winding wire, or may be formed by joining end portions of the two winding portions 2*c* through welding or the like, for example. The specifications of the winding wire and the winding portions 2*c* can be changed as appropriate, and the two winding portions 2*c* may have different shapes, sizes, winding directions, and numbers of turns. The winding portions 2*c* may have a tubular shape. The tubular winding portion refer to a winding portion having an end face having a closed curved surface shape (elliptical shape, perfectly circular shape, race track shape, or the like).

Magnetic Core

As shown in FIGS. 1 and 2, the magnetic core 3 includes a pair of inner core portions 31 that are respectively disposed in the inner portions of the two winding portions 2*c*, and a pair of outer core portions 32 that are disposed in the outer portions of the winding portions 2*c*. The magnetic core 3 has an annular shape as a result of the pair of outer core portions 32 being disposed to hold the pair of inner core portions 31 that are spaced apart from each other and end faces 31*e* of the inner core portions 31 and inner end face 32*e* of the outer core portions 32 being brought into contact with each other. When the coil 2 is excited, a closed magnetic circuit is formed in the annular magnetic core 3.

Inner Core Portion

The inner core portions 31 are portions of the magnetic core 3 that extend along the axial direction of the winding portions 2*c*. In this example, two end portions of the portions of the magnetic core 3 that extend along the axial direction of the winding portions 2*c* protrude from the end faces of the winding portions 2*c*. The protruding portions are also portions of the inner core portions 31. The end portions of the inner core portions 31 that protrude from the winding portions 2*c* are inserted into through-holes 40 (FIG. 2) of the holding members 4, which will be described later.

The inner core portions 31 form a single body having a non-separated structure. Because the inner core portions 31 form a single body having a non-separated structure, when a fitting structure is formed by the inner resin portion 51 with which the inside of the groove portions 311, which will be described later, is filled, the inner core portions 31 and the outer core portions 32 can be firmly held by the resin molded portion 5 as a single body. There is no particular limitation on the shape of the inner core portions 31 as long as the shape thereof extends along the shape of the inner portion of the winding portion 2*c*. As shown in FIG. 2, the inner core portions 31 in this example have a substantially rectangular parallelepiped shape.

The inner core portions 31 include groove portions 311 that are provided in surfaces in the vicinities of end portions thereof in the axial direction and extend in a direction intersecting with the axial direction. When the entire length of the inner core portion 31 in the length direction is L, the vicinities of end portions of the inner core portion 31 in the axial direction refer to a range with 20% of the entire length L or less from the end faces 31*e* of the inner core portion 31.

The groove portion 311 is provided in at least a portion in the circumferential direction of the inner core portion 31. The groove portion 311 may be provided continuously or non-continuously when viewed in the circumferential direction of the inner core portion 31. When the entire length in the circumferential direction of the inner core portion 31 is M, each groove portion 311 is provided such that the length of the groove portion 311 extending along the circumferential direction of the inner core portion 31 (if the groove portion 311 is provided non-continuously, the total length thereof) is 40% of the entire length M or more, 75% of the entire length M or more, and particularly, the entire length M, for example. The groove portions 311 in this example are provided along a direction orthogonal to the axial direction of the inner core portion 31, that is, along the circumferential direction of the inner core portion 31, and over the entire length of the inner core portion 31 in the circumferential direction.

Each groove portion 311 preferably has portions located in opposing surfaces of the inner core portion 31. As shown in FIG. 2, if the inner core portion 31 has a substantially rectangular parallelepiped shape, the inner core portion 31 has two flat opposing surfaces. Specifically, the inner core portion 31 has first two flat opposing surfaces constituted by an upper face 31*u* and a lower face 31*d*, and second two flat opposing surfaces constituted by an outer face 31*o* and an inner face 31*i*. At this time, it is preferable that the groove portions 311 are provided in at least portions of at least one two flat surfaces of the first two flat opposing surfaces and the second two flat opposing surfaces. In this case, examples of the form of the groove portion include the following five forms. In the first form, at least portions of the upper face 31*u* and the lower face 31*d* respectively include groove portions, and the outer face 31*o* and the inner face 31*i* do not include groove portions. In the second form, at least portions of the outer face 31*o* and the inner face 31*i* respectively include groove portions, and the upper face 31*u* and the lower face 32*d* do not include groove portions. In the third form, at least portions of the upper face 31*u* and the lower face 31*d* respectively include groove portions, one of the outer face 31*o* and the inner face 31*i* that connect the upper face 31*u* and the lower face 31*d* includes a groove portion that is continuous or non-continuous with the above-described groove portions, and the other of the outer face 31*o* and the inner face 31*i* does not include a groove portion. In the fourth form, at least portions of the outer face 31*o* and the inner face 31*i* respectively include groove portions, one of the upper face 31*u* and the lower face 31*d* that connect the outer surface 31*o* and the inner face 31*i* includes a groove portion that is continuous or non-continuous with the above-described groove portions, and the other of the upper face 31*u* and the lower face 31*d* do not include a groove portion. In the fifth form, all of the upper face 31*u*, the lower face 31*d*, the outer face 31*o*, and the inner face 31*i* include groove portions that are continuous or non-continuous with each other.

In addition, if the inner core portion 31 has a substantially round columnar shape, the groove portions 311 are preferably provided at positions that are located opposite to each other in the radial direction. Multiple pairs of groove portions may be provided at positions that are located opposite to each other in the radial direction of the inner core portion 31, or one continuous groove portion may be provided which has portions provided at positions that are located opposite to each other in the radial direction of the inner core portion 31, for example. In other words, this is a configuration in which a groove portion is provided over a half the circumferential direction of the inner core portion 31 or more.

The groove portion 311 may have a depth of 0.5 mm to 4 mm inclusive, for example. When the groove portion 311 has a depth of 0.5 mm or more, the inner portion of the groove portion 311 is likely to be filled with a portion of the resin molded portion 5, which will be described later. The resin molded portion 5 (inner resin portion 51) with which the inside of the groove portion 311 is filled has a fitting structure in which the inner resin portion 51 is hooked on the inner core portion 31. Thus, the deeper the groove portion 311 is, the more easily the above-described fitting structure can be formed, and the depth thereof may be 1 mm or more, and particularly 2 mm or more, for example. On the other hand, because the groove portion 311 has a depth of 4 mm or less, the passage of magnetic flux is unlikely to be inhibited, and deterioration of the magnetic properties can be easily suppressed. The groove portion 311 may also have a depth of 3 mm or less, and particularly 2.5 mm or less, for example.

There is no particular limitation on the cross-sectional shape of the groove portion 311 as long as it is possible to form a fitting structure in which the inner portion of the groove portion 311 is filled with a portion of the resin molded portion 5, which will be described later, and the resin molded portion 5 filled therein is hooked on the inner core portion 31. Examples of the cross-sectional shape of the groove portion 311 include a rectangular shape, a V-shape, a semicircular shape, and a semioval shape. The cross-sectional shape of the groove portion 311 may be such that the inner face of the two inner faces of the groove portion 311 located on the outer core portion 32 side has a linear shape that is parallel to the end face 31*e* of the inner core portion 31. This makes it possible to easily form the above-described fitting structure having a high drag force against the force for separating the inner core portions 31 and the outer core portions 32. In this example, the cross-sectional shape of the groove portions 311 is a rectangular shape.

The inner core portion 31 may be composed of a compact made of a composite material in which soft magnetic powder is dispersed in resin. Because the inner core portion 31 is composed of a compact made of the above-described composite material, the groove portion 311 can be easily formed in the surface of the inner core portion 31. This is because the groove portion 311 can also be formed when the inner core portion 31 is formed using the composite material. The inner core portions 31 can also be composed of a powder compact obtained by compression molding soft magnetic powder or coated soft magnetic powder provided with an insulating coating.

Composite Material

The soft magnetic powder of a composite material is an aggregate of soft magnetic particles composed of iron group metals such as iron, the alloys thereof (Fe—Si alloy, Fe—Ni alloy, and the like), or the like. An insulating coating composed of phosphates or the like may also be formed on the surface of soft magnetic particles. On the other hand, examples of resin contained in the composite material include thermosetting resins, thermoplastic resins, room temperature curable resins, low-temperature curable resins, and the like. Examples of the thermosetting resin include unsaturated polyester resins, epoxy resins, urethane resins, and silicone resins. Examples of the thermoplastic resin include polyphenylene sulfide (PPS) resins, polytetrafluoroethylene (PTFE) resins, liquid crystal polymers (LCPs), polyamide (PA) resins (e.g., nylon 6 and nylon 66), polybutylene terephthalate (PBT) resins, and acrylonitrile butadiene styrene (ABS) resins. In addition, a BMC (Bulk molding compound) obtained by mixing calcium carbonate and glass fiber to unsaturated polyester, millable silicone rubber, millable urethane rubber, and the like can be used. If the composite material contains nonmagnetic and non-metallic powder (filler) such as alumina or silica powder, as well as soft magnetic powder and resin, heat dissipation properties can be further improved. Examples of the content of nonmagnetic and non-metallic powder include 0.2 mass % to 20 mass % inclusive, 0.3 mass % to 15 mass % inclusive, and 0.5 mass % to 10 mass % inclusive.

An example of the content of soft magnetic powder in the composite material is 30 vol % to 80 vol % inclusive. From the viewpoint of improving the saturation flux density and heat dissipation properties, examples of the content of magnetic powder further include 50 vol % or more, 60 vol % or more, and 70 vol % or more. From the viewpoint of improving flowability in the manufacturing process, the content of magnetic powder is preferably set to 75 vol % or less.

If the ratio of soft magnetic powder with which a compact composed of a composite material is filled is adjusted to be low, the relative magnetic permeability thereof can be readily reduced. An example of the relative magnetic permeability of the compact made of the composite material is 5 to 50 inclusive. The relative magnetic permeability of the composite material may also be 10 to 45 inclusive, 15 to 40 inclusive, and 20 to 35 inclusive.

Powder Compact

It is possible to use the same soft magnetic powder as that of the composite material, as the soft magnetic powder of the powder compact. The powder compact is likely to have a higher content of soft magnetic powder, a higher saturated magnetic flux density, and higher relative magnetic permeability, compared to the compact composed of the composite material. Examples of the content of soft magnetic powder in the powder compact exceeds 80 vol %, and 85 vol % or more. An example of the relative magnetic permeability of the powder compact is 50 to 500 inclusive. The relative magnetic permeability of the powder compact may also be 80 or more, 100 or more, 150 or more, and 180 or more.

Outer Core Portion

The outer core portions 32 are portions of the magnetic core 3 that are disposed in the outer portions of the winding portions 2*c*. There is no particular limitation on the shape of the outer core portions 32 as long as each outer core portion 32 connects end portions of the two inner core portions 31. The outer core portions 32 in this example are each a block body in which the upper face 32*u* and the lower face 32*d* thereof has a substantially dome shape. The outer core portion 32 includes the upper face 32*u*, the lower face 32*d*, an inner end face 32*e*, and an outer circumferential face 32*o*. The inner end face 32*e* is in contact with the end faces 31*e* of the inner core portions 31. An adhesive may be interposed or need not be interposed between the inner end face 32*e* of the outer core portion 32 and the end faces 31*e* of the inner core portions 31. The outer core portions 32 in this example are each a single body composed of a powder compact and having a non-separated structure. The outer core portion 32 may be composed of a compact made of a composite material that is similar to that of the inner core portion 31, or may be composed of a powder compact.

In addition, the outer core portion 32 may have a U-shape having portions disposed in the inner portions of the winding portions 2*c*. The U-shaped outer core portion 32 includes a block body disposed in the outer portions of the winding portions 2*c* and extending across the winding portions 2*c*, and two protruding portions that protrude from the block body and are respectively disposed on the inner portions of the winding portions 2*c*. The protruding portions have a protruding length long enough to be disposed in the vicinities of the end faces of the winding portions 2*c*. This is because resin can be easily guided to the groove portions 311 formed in the inner core portions 31 because the protruding portions are short. In the case of the U-shaped outer core portion 32, the protruding portions are inserted into through-holes 40 in the holding members 4, which will be described later.

Holding Member

Figure 3:
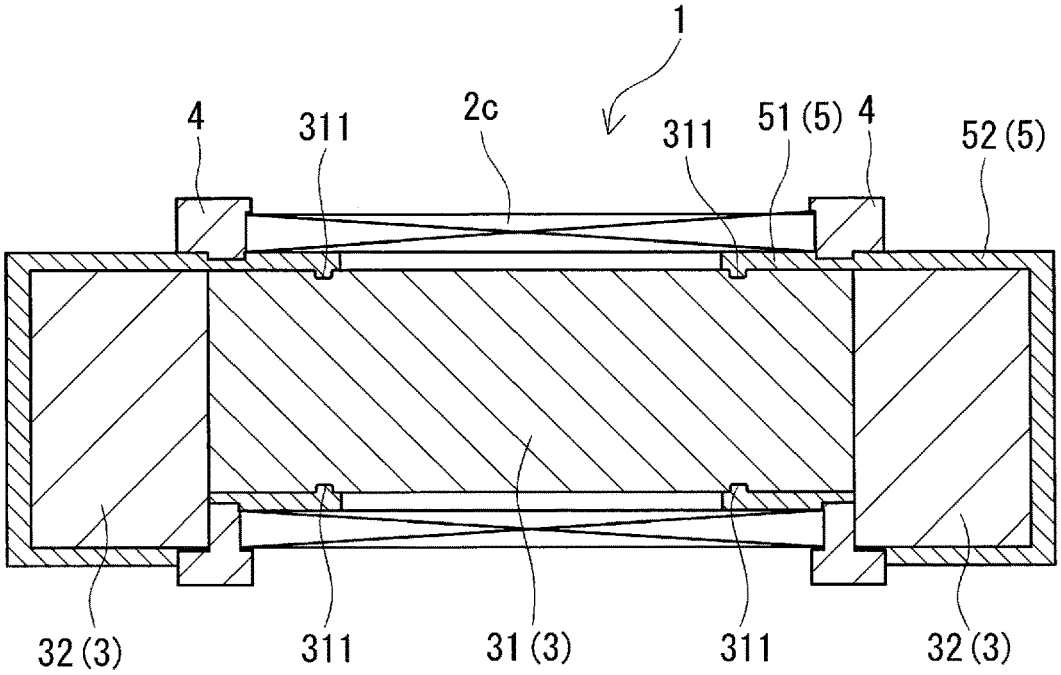
FIG. 3 is a schematic longitudinal cross-sectional view obtained by cutting along line (III)-(III) shown in FIG. 1.

Each holding member 4 is interposed between the end faces of the winding portions 2*c* and the inner end face 32*e* of the outer core portion 32, and hold the end faces of the winding portions 2*c* in the axial direction and the outer core portion 32 (FIG. 3). The holding member 4 is typically composed of an insulating material. The holding member 4 functions as an insulating member located between the coil 2 and the magnetic core 3. Also, the holding members 4 function as positioning members for positioning the inner core portions 31 and the outer core portions 32 with respect to the winding portions 2*c*. In this example, two holding members 4 having the same shape are provided.

Each holding member 4 includes a pair of through-holes 40, core support portions 41, coil accommodation portions 42, and a core accommodation portion 43. The through-holes 40 pass through the holding member 4 in the thickness direction thereof, and end portions of the inner core portions 31 are inserted therein. The core support portions 41 respectively protrude from the inner circumferential faces of the through-holes 40 toward the centers of the inner core portions 31. The core support portions 41 support surfaces of the end portions of the inner core portions 31 such that the groove portions 311 provided in the inner core portions 31 are exposed. The coil accommodation portions 42 are annular recesses formed to respectively surround the core support portions 41, and have a depth extending along the shape of the end faces of the winding portions 2*c*. The end faces of the winding portions 2*c* and the vicinities thereof are fitted to these recesses. Each core accommodation portion 43 is formed as a result of a portion of a surface of the holding member 4 located on the outer core portion 32 side being recessed in the thickness direction, and the inner end face 32*e* of the outer core portion 32 and the vicinity thereof are fitted thereto. The end faces 31*e* of the inner core portions 31 fitted to the through-holes 40 in the holding members 4 are substantially flush with the bottom faces of the core accommodation portions 43. Thus, the end faces 31*e* of the inner core portions 31 are in contact with the inner end faces 32*e* of the outer core portions 32.

Here, four corners of a through-hole 40 in this example (portions integrated with a core support portion 41) have a shape that substantially extends along the corner portions of the end face 31*e* of the inner core portion 31. The inner core portion 31 is supported by the four corners of this through-hole 40 in the through-hole 40. An upper edge portion, a lower edge portion, and two side edge portions other than the four corners of this through-hole 40 extend on the outer side of a contour line of the end face 31*e* of the inner core portion 31. Thus, a gap passing through the holding member 4 is formed at a position in the extending portion in a state in which the inner core portion 31 is inserted into the through-hole 40. The core accommodation portion 43 is a shallow recess provided with a bottom face that includes the above-described pair of through-holes 40. When the outer core portion 32 is fitted to the core accommodation portion 43, the inner end face 32*e* of the outer core portion 32 fitted to the core accommodation portion 43 is in contact with and is supported by the bottom face of the core accommodation portion 43. This bottom face is an inverted T-shaped face constituted by a portion that is held by the two through-holes 40 and extends along the height direction, and a portion extending along the width direction on the lower side of the through-holes 40. As shown in the schematic front view of FIG. 4, the core accommodation portion 43 has a shape that substantially extends along the contour line of the outer core portion 32, and an upper edge portion of the core accommodation portion 43 and upper portions of the side edge portions extend outward of the above-described contour line. Portions other than the portions extending outward extend along the contour line of the outer core portion 32, and thus the movement of the outer core portion 32 in the left-right direction (the direction in which the through-holes 40 are disposed in parallel to each other) fitted to the core accommodation portion 43 is restricted.

Figure 4:
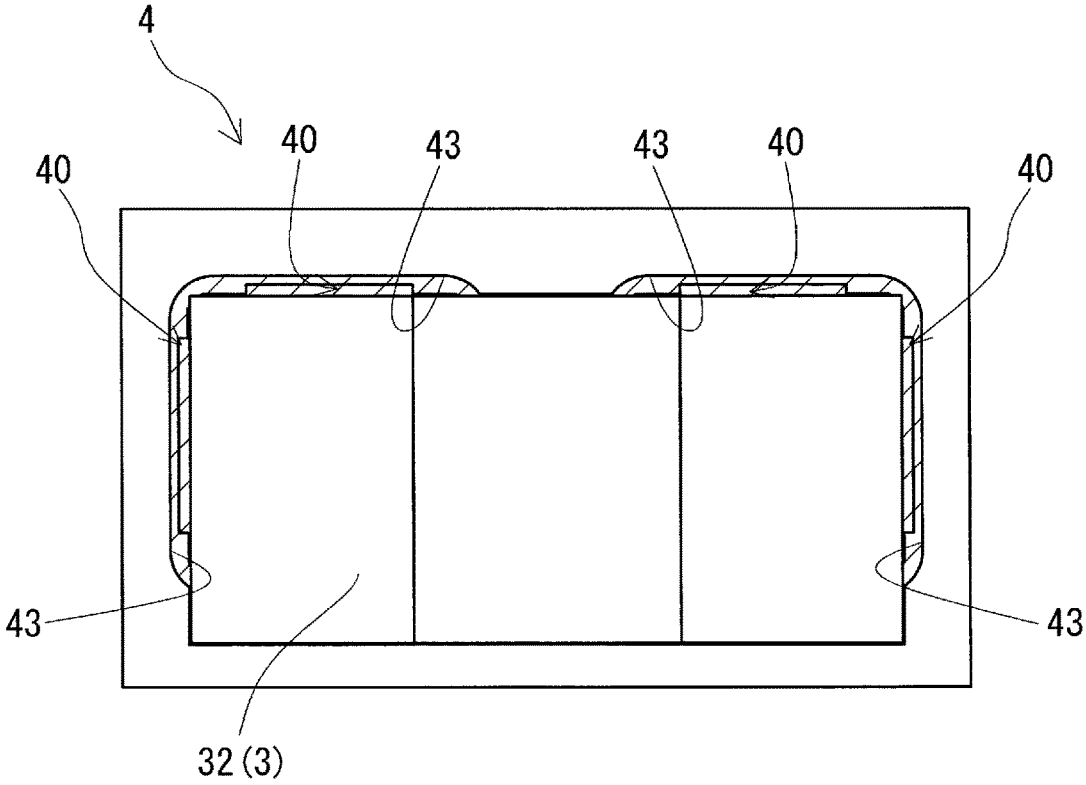
FIG. 4 is a schematic front view of the assembly provided in the reactor according to Embodiment 1, when viewed from the outer core portion side.

As shown in FIG. 4, when the outer core portion 32 is fitted to the above-described core accommodation portion 43, gaps are formed between an inner wall face of the core accommodation portion 43 and the outer circumferential face 32*o* of the outer core portion 32 (hatched portions shown in FIG. 4). The gap is continuous with gaps formed between the inner circumferential faces of the through-holes 40 and the circumferential faces of the inner core portions 31. Thus, when an outer resin portion 52 is formed by molding resin on the surface (the upper face 32*u*, the lower face 32*d*, and the outer circumferential face 32*o*) of the outer core portion 32, the resin flows in between the winding portions 2*c* and the inner core portions 31. The resin that has flows in between the winding portions 2*c* and the inner core portions 31 forms the inner resin portion 51 covering the surfaces (the upper faces 31*u*, the lower faces 32*d*, the outer faces 31*o*, and the inner faces 31*i*) of the inner core portions 31. That is, the above-described gaps function as resin filling holes for guiding resin in between the winding portions 2*c* and the inner core portions 31.

In this example, the core support portion 41 includes notch portions 411 that extend from two side edge portions of the inner circumferential face of the through-hole 40 to the groove portion 311 formed in the inner core portion 31. This notch portion 411 is formed at a portion corresponding to the gap formed between the inner circumferential face of the through-hole 40 and the inner face of the inner core portion 31. The above described gaps between the inner wall faces of the core accommodation portions 43 and the outer circumferential faces 32*o* of the outer core portions 32, and gaps between the inner circumferential faces of the through-holes 40 and the circumferential faces of the inner core portions 31 serve as the paths through which resin flows. The resin that has flowed through the flow paths and has entered is likely to enter between the winding portions 2*c* and the inner core portions 31 through the notch portions 411, and the inside of the groove portions 311 is readily filled with the resin. That is, the notch portions 411 function as resin flow paths for guiding resin in between the winding portions 2*c* and the inner core portions 31. The notch portions 411 in this example are formed along the axial direction of the through-holes 40.

The holding member 4 can be composed of a thermoplastic resin such as a polyphenylene sulfide (PPS) resin, a polytetrafluoroethylene (PTFE) resin, a liquid crystal polymer (LCP), a polyamide (PA) resin (e.g., nylon 6 or nylon 66), a polybutylene terephthalate (PBT) resin, or an acrylonitrile butadiene styrene (ABS) resin. In addition, it is possible to form the holding member 4, using a thermosetting resin such as an unsaturated polyester resin, an epoxy resin, a urethane resin, or a silicone resin. The heat dissipation properties of the holding member 4 may be improved by adding ceramic filler to these resins. It is possible to use nonmagnetic powder such as alumina or silica powder as the ceramic filler, for example.

Resin Molded Portion

The resin molded portion 5 covers at least a portion of the surface of the magnetic core 3 and holds the inner core portions 31 and the outer core portions 32 as a single body. The resin molded portion 5 includes the outer resin portion 52 covering at least a portion of the surfaces of the outer core portions 32, and the inner resin portion 51 covering a surface of end portions in the axial direction of the inner core portions 31. The outer resin portion 52 and the inner resin portion 51 are a continuous single body.

Although gaps between the winding portions 2*c* and the inner core portions 31 are exaggerated in FIG. 3, actually, the gaps are very narrow, and thus resin is unlikely to enter the gaps. Thus, the resin molded portion 5 does not extend to the central portions of the inner core portions 31 in the axial direction. In view of the function of the resin molded portion 5 to hold the inner core portions 31 and the outer core portions 32 as a single body, a sufficient range where the resin molded portion 5 is formed extends up to the vicinities of the end portions of the inner core portions 31. Note that the resin molded portion 5 may extend up to the central portions of the inner core portions 31 in the axial direction. That is, the inner resin portion 51 may be formed over the entire length of the inner core portion 31 in the length direction of the inner core portion 31.

The resin molded portion 5 is formed by molding the outer circumference of the assembly 10 that includes the winding portions 2*c*, the magnetic core 3, and the holding members 4 with an unhardened resin. The unhardened resin covers at least a portion of the surfaces of the outer core portions 32. When the resin is hardened, the outer resin portion 52 is formed. The outer resin portion 52 in this example is provided to cover the surface (the upper faces 32*u*, the lower faces 32*d*, and the outer circumferential faces 32*o*) other than the inner end faces 32*e* of the outer core portions 32. The outer resin portion 52 may also be provided such that the lower faces 32*d* of the outer core portions 32 are exposed, for example. Also, when the surfaces of the outer core portions 32 are molded using an unhardened resin, portions of the unhardened resin also enter gaps located between the winding portions 2*c* and the inner core portions 31, and cover the surfaces of the end portions of the inner core portions 31. At this time, the unhardened resin flows through the notch portions 411 formed in the core support portions 41 of the holding members 4 to the groove portions 311 formed in the inner core portions 31, and the inner portions of the groove portions 311 are filled with the resin. When the resin that has entered between the winding portions 2*c* and the inner core portions 31 is hardened, the inner resin portion 51 is formed.

The inner resin portion 51 in the groove portions 311 has a fitting structure in which the inner resin portion 51 is hooked on the inner core portions 31. The inner core portions 31 and the outer core portions 32 are firmly formed as a single body by the resin molded portion 5 due to this fitting structure. Thus, the thickness of the resin molded portion 5 needs not to be excessively increased. The thickness of the resin molded portion 5 may be 5 mm or less, 3 mm or less, and particularly 2 mm or less. Note that the thickness of the resin molded portion 5 may be 1 mm or more, for example.

It is possible to use a thermosetting resin such as an epoxy resin, a phenolic resin, a silicone resin, or a urethane resin, a thermoplastic resin such as a PPS resin, a PA resin, a polyimide resin, or a fluororesin, a room temperature curable resin, or a low-temperature curable resin for the resin molded portion 5. The heat dissipation properties of the resin molded portion 5 may be improved by adding ceramic filler such as alumina filler or silica filler to these resins.

Modes of Usage

The reactor 1 of this example can be used for constituent components of power conversion devices such as bidirectional DC-DC converters installed in electrically driven vehicles such as hybrid automobiles, electric automobiles, and fuel cell automobiles. The reactor 1 of this example can be used in a state in which the reactor 1 is immersed in a liquid refrigerant. Although the liquid refrigerant is not particularly limited, if the reactor 1 is utilized in a hybrid automobile, ATF (Automatic Transmission Fluid) or the like can be used as the liquid refrigerant. In addition, it is also possible to use fluorine-based inert fluids such as Florinert (registered trademark), chlorofluorocarbon refrigerants such as HCFC-123 and HFC-134a, alcohol-based refrigerants such as methanol and alcohol, ketone-based refrigerants such as acetone, and the like, as a liquid refrigerant.

Effects

The above-described reactor 1 has a fitting structure in which the inner resin portion 51 in the groove portions 311 is hooked on the inner core portions 31. The inner core portions 31 and the outer core portions 32 can be firmly held as a single body by the resin molded portion 5 due to this fitting structure. Also, due to the above-described fitting structure, it is possible to firmly hold the magnetic core 3 as a single body without making the resin molded portion 5 thicker than necessary. Thus, it is possible to narrow the space between the winding portion 2*c* and the inner core portion 31, and to obtain a small reactor 1. Even if the space between the winding portion 2*c* and the inner core portion 31 is narrowed, it is possible to reliably fill the groove portions 311 with a portion of the inner resin portion 51 due to the groove portions 311 being provided in the vicinities of the end portions of the inner core portions 31. In particular, because the core support portions 41 of the holding members 4 include the notch portions 411, resin can be easily guided to the groove portions 311, using the notch portions 411 as the paths through which the resin flows. In the reactor 1 of this example, the groove portions 311 are provided over the entire length in the circumferential direction of the inner core portions 31. Thus, the inner core portions 31 and the outer core portions 32 can be stably and firmly held as a single body by the resin molded portion 5 due to the above-described fitting structure.

Embodiment 2

Figure 5:
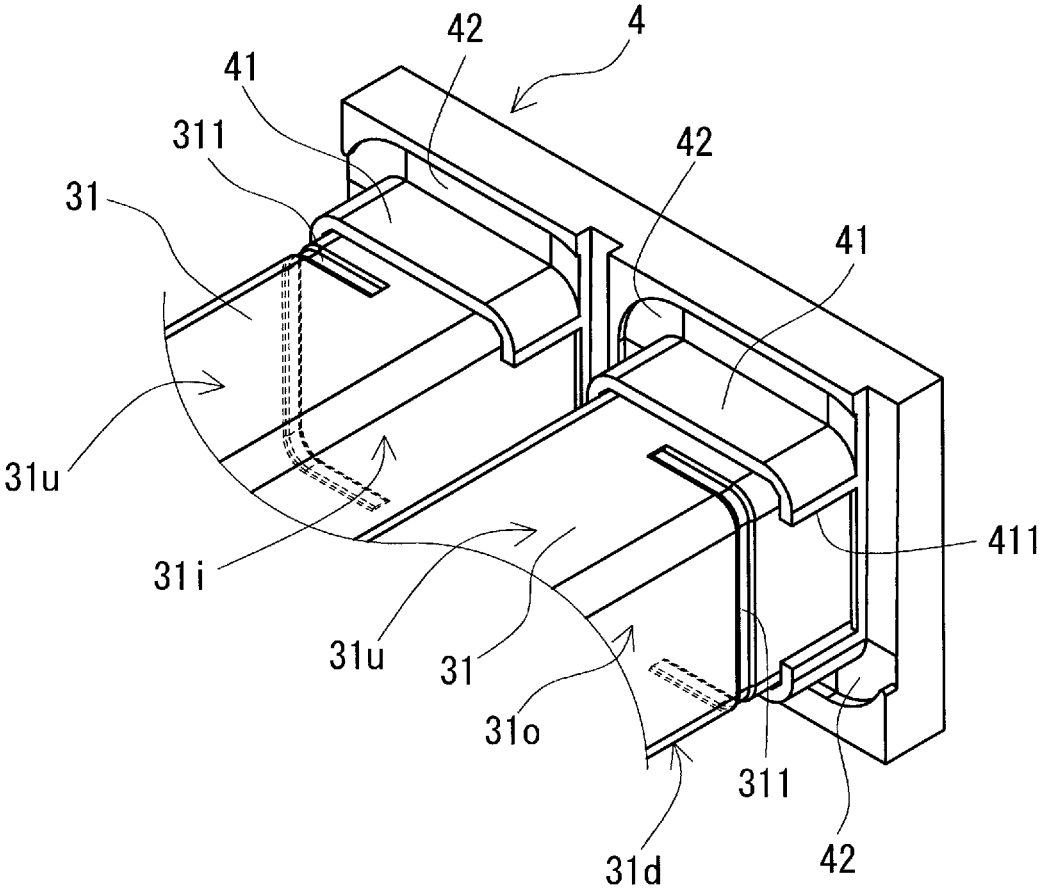
FIG. 5 is a schematic perspective view showing the vicinities of end portions of inner core portions in an axial direction provided in a reactor according to Embodiment 2.

A reactor according to Embodiment 2 will be described below based on FIG. 5. The reactor according to Embodiment 2 is different from that of Embodiment 1 in the region where the groove portions 311 are formed. FIG. 5 shows only the vicinities of the end portions of the inner core portions 31 in the axial direction thereof. The constituent elements other than the region where the groove portions 311 are formed are the same as those of Embodiment 1, and thus will not be described.

Each groove portion 311 of this example is continuously provided in the upper face 31*u*, the lower face 31*d*, and the outer face 31*o* of the inner core portion 31, and no groove portion 311 is provided in the inner face 31*i*. That is, the groove portion 311 includes one end located in the upper face 31*u* of the inner core portion 31, the other end located in the lower face 31*d*, and an intermediate portion that connects the one end and the other end and is located in the outer face 31*o*. In this example, the one end of the groove portion 311 is located in a central portion in the width direction of the upper face 31*u*. Also, the other end of the groove portion 311 is located in a central portion in the width direction of the lower face 31*d*.

If two inner core portions 31 that are respectively disposed in the inner portions of two winding portions 2*c* are provided, magnetic flux is likely to pass through regions of the inner core portions 31 located inward in the direction in which the winding portions 2*c* are disposed in parallel to each other. Thus, it is better not to provide the groove portion 311 in the surfaces of the inner core portion 31 located inward in the parallel direction. Here, a region of the inner core portions 31 located inward in the parallel direction refers to a portion held by the two inner core portions 31 (winding portions 2*c*) that are disposed in parallel to each other, that is to say, a portion close to the centerline located between the two inner core portions 31 (winding portions 2*c*) that are disposed in parallel to each other. On the other hand, a region of the inner core portions 31 located outward in the parallel direction refers to a portion opposite to the portion held by the two parallel inner core portions 31 (winding portions 2*c*), that is to say, a portion away from the centerline located between the two inner core portions 31 (winding portions 2*c*). Because the groove portions 311 are provided in the surfaces of the inner core portions 31 located outward in the parallel direction, it is possible to form a fitting structure due to the inner resin portion 51, and the passage of magnetic flux is unlikely to be inhibited. Because the groove portions 311 are each continuously provided across the upper face 31*u*, the outer face 31*o*, and the lower face 31*d* of the inner core portion 31, the inner core portions 31 and the outer core portions 32 can be easily, stably, and firmly held as a single body by the resin molded portion 5. Note that the groove portion 311 may also be provided non-continuously in the upper face 31*u*, the outer face 31*o*, and the lower face 31*d*.

Embodiment 3

Figure 6:
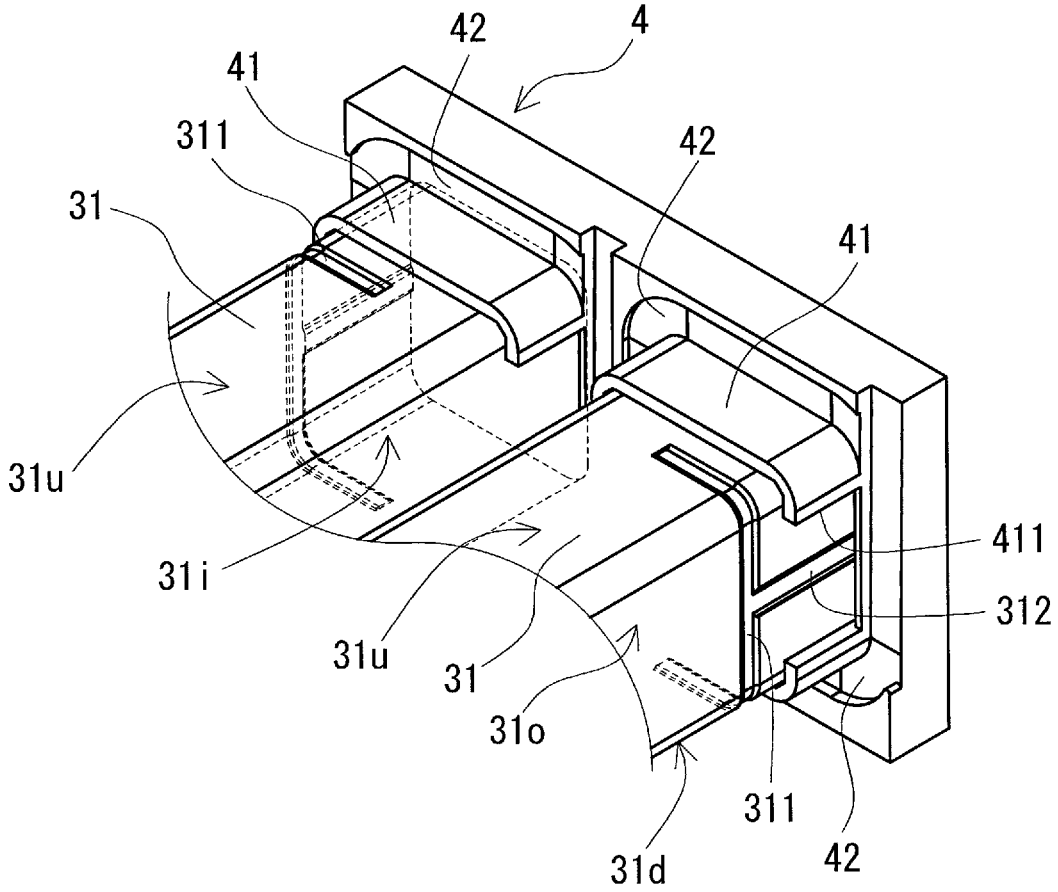
FIG. 6 is a schematic perspective view showing the vicinities of end portions of inner core portions in an axial direction provided in a reactor according to Embodiment 3.

A reactor according to Embodiment 3 will be described below based on FIG. 6. The reactor according to Embodiment 3 is different from those of Embodiments 1 and 2 in that the inner core portions 31 include guide groove portions 312. FIG. 6 shows only the vicinities of the end portions of the inner core portions 31 in the axial direction thereof. Also, similarly to FIG. 5, FIG. 6 shows the region where the groove portions 311 are formed. The region where the groove portions 311 are formed may be the same as that of Embodiment 1. The constituent elements other than the guide groove portions 312 are the same as those of Embodiments 1 and 2, and thus will not be described.

Each guide groove portion 312 is provided from an end face 31*e* (FIG. 2) of the inner core portion 31 toward the groove portion 311. In this example, the guide groove portion 312 is provided to connect the end face 31*e* of the inner core portion 31 and the groove portion 311 along the axial direction of the inner core portion 31. Also, the guide groove portion 312 is provided at a position corresponding to a notch portion 411 formed in a core support portion 41 of a holding member 4. The depth and the cross-sectional shape of the guide groove portion 312 may be the same as or different from those of the groove portion 311.

Because the inner core portions 31 include the guide groove portions 312, when the outer resin portion 52 is formed by molding resin on the surface of the outer core portions 32, the resin is likely to pass through the guide groove portions 312 and flow into the groove portions 311, and the inside of the groove portions 311 is readily filled with the resin. Because the inside of the guide groove portion 312 is also filled with the resin, the area of contact between the resin molded portion 5 and the inner core portions 31 can be increased. Thus, it is possible to easily and firmly hold the resin molded portion 5 and the inner core portions 31, and to easily and more firmly hold the inner core portions 31 and the outer core portions 32 as a single body via the resin molded portion 5.

The guide groove portion 312 may also be provided to connect the end face 31*e* of the inner core portion 31 and the groove portion 311 along the direction intersecting with the axial direction of the inner core portion 31. In this case, the resin (the inner resin portion 51) with which the inside of the guide groove portions 312 is filled can also form a fitting structure capable of applying a drag force against the force for separating the inner core portions 31 and the outer core portions 32.

The invention claimed is:

1. A reactor comprising:

a coil having a winding portion;

a magnetic core having an inner core portion and an outer core portion; and a resin molded portion covering at least a portion of a surface of the magnetic core, wherein the inner core portion is disposed in an inner portion of the winding portion, the outer core portion is disposed in an outer portion of the winding portion, the inner core portion is a single body having a non-separated structure, and the inner core portion includes a groove portion provided along a direction intersecting with an axial direction in a surface in the vicinity of an end portion of the inner core portion located in the axial direction, the resin molded portion includes:

an outer resin portion covering at least a portion of a surface of the outer core portion, and an inner resin portion that covers the surface of the end portion of the inner core portion located in the axial direction and with which an inner portion of the groove portion is filled, and the inner resin portion is continuous with the outer resin portion.

2. The reactor according to claim 1, comprising:

a holding member for holding an end face of the winding portion in an axial direction of the winding portion and the outer core portion, wherein the holding member is a frame-shaped body having a through-hole into which the end portion of the inner core portion located in the axial direction is inserted, the holding member includes a core support portion that protrudes from an inner circumferential face of the through-hole toward the center of the inner core portion, the core support portion is configured to support the surface of the end portion of the inner core portion located in the axial direction such that the groove portion is exposed, and the core support portion includes a notch portion that extends from the inner circumferential face of the through-hole to the groove portion.

3. The reactor according to claim 1, wherein the groove portion has portions located in opposing surfaces of the inner core portion.

4. The reactor according to claim 3, wherein the coil includes a pair of the winding portions that are disposed in parallel to each other, the inner core portion includes a pair of the inner core portions that are respectively disposed in inner portions of the winding portions, the groove portion includes:

one end and another end that are located in opposing surfaces of the inner core portion, and an intermediate portion connecting the one end and the other end, and the intermediate portion is provided in a surface of the inner core portion located outward in a direction in which the inner core portions are disposed in parallel to each other.

5. The reactor according to claim 1, wherein the inner core portion is composed of a compact made of a composite material in which soft magnetic powder is dispersed in resin.

6. The reactor according to claim 1, wherein the inner core portion includes a guide groove portion provided from an end face of the inner core portion located in the axial direction toward the groove portion.

7. The reactor according to claim 2, wherein the groove portion has portions located in opposing surfaces of the inner core portion.

8. The reactor according to claim 2, wherein the inner core portion is composed of a compact made of a composite material in which soft magnetic powder is dispersed in resin.

9. The reactor according to claim 3, wherein the inner core portion is composed of a compact made of a composite material in which soft magnetic powder is dispersed in resin.

10. The reactor according to claim 4, wherein the inner core portion is composed of a compact made of a composite material in which soft magnetic powder is dispersed in resin.

11. The reactor according to claim 2, wherein the inner core portion includes a guide groove portion provided from an end face of the inner core portion located in the axial direction toward the groove portion.

12. The reactor according to claim 3, wherein the inner core portion includes a guide groove portion provided from an end face of the inner core portion located in the axial direction toward the groove portion.

13. The reactor according to claim 4, wherein the inner core portion includes a guide groove portion provided from an end face of the inner core portion located in the axial direction toward the groove portion.

14. The reactor according to claim 5, wherein the inner core portion includes a guide groove portion provided from an end face of the inner core portion located in the axial direction toward the groove portion.

* * * * *